US009951583B2

(12) United States Patent
Gosselin et al.

(10) Patent No.: US 9,951,583 B2
(45) Date of Patent: Apr. 24, 2018

(54) RECIPROCATING WELLBORE OBSTRUCTION-CLEARING TOOL AND BAILER

(71) Applicant: LONGHORN CASING TOOLS INC., Calgary (CA)

(72) Inventors: Randy Gosselin, High River (CA); Trevor James Montgomery, Calgary (CA); Duwayne Springer, Lloydminster (CA)

(73) Assignee: LONGHORN CASING TOOLS INC., Calgary (CA)

( * ) Notice: Subject to any disclaimer, the term of this patent is extended or adjusted under 35 U.S.C. 154(b) by 170 days.

(21) Appl. No.: 15/145,082

(22) Filed: May 3, 2016

(65) Prior Publication Data

US 2016/0326821 A1 Nov. 10, 2016

Related U.S. Application Data

(60) Provisional application No. 62/157,004, filed on May 5, 2015.

(51) Int. Cl.

| | |
|---|---|
| ***E21B 37/10*** | (2006.01) |
| ***E21B 37/00*** | (2006.01) |
| ***E21B 37/02*** | (2006.01) |
| ***E21B 17/07*** | (2006.01) |
| ***E21B 34/08*** | (2006.01) |

(52) U.S. Cl.

CPC ..... *E21B 37/10* (2013.01); *E21B 17/073* (2013.01); *E21B 34/08* (2013.01); *E21B 37/00* (2013.01); *E21B 37/02* (2013.01)

(58) Field of Classification Search

CPC ..... E21B 37/00; E21B 37/10; E21B 34/00; E21B 34/06; E21B 34/08; E21B 21/00; E21B 37/02; E21B 17/073

See application file for complete search history.

(56) References Cited

U.S. PATENT DOCUMENTS

| | | | | |
|---|---|---|---|---|
| 4,190,113 A * | 2/1980 | Harrison | ..... | E21B 27/00 166/107 |
| 4,270,620 A * | 6/1981 | Lawrence | ..... | E21B 17/07 175/322 |
| 4,505,341 A * | 3/1985 | Moody | ..... | E21B 21/00 166/105.1 |
| 2007/0056773 A1* | 3/2007 | Booth | ..... | E21B 17/22 175/57 |

(Continued)

*Primary Examiner* — Yong-Suk Ro

(74) *Attorney, Agent, or Firm* — Parlee McLaws LLP (CGY); Sean Goodwin; Linda Thompson

(57) ABSTRACT

A tool is incorporated into a tubing string and is run into a wellbore until an agitator at a bottom of the tool engages an obstruction in the wellbore. A helical drive arrangement between a mandrel and a sleeve causes the sleeve on the outside of the tool, to which the agitator is attached, to rotate as the mandrel is reciprocated between a downstroke and an upstroke. Rotation of the agitator disrupts the obstruction forming debris therefrom and a slurry of the debris in wellbore fluid. At the same time, reciprocation of the mandrel causes a standing valve and a travelling valve in the tool to be alternately opened and closed for pumping the slurry into the tool and from the tool into the tubing string for storage therein. Periodically the tool is tripped to surface and the stored debris is removed from the tubing string.

13 Claims, 14 Drawing Sheets

(56) References Cited

U.S. PATENT DOCUMENTS

2009/0178799 A1* 7/2009 Shewchuk ..... E21B 37/10
166/105.2
2012/0285743 A1* 11/2012 Gosselin ..... E21B 17/073
175/53

* cited by examiner

RECIPROCATING WELLBORE OBSTRUCTION-CLEARING TOOL AND BAILER

CROSS-REFERENCE TO RELATED APPLICATIONS

This application claims the benefit of U.S. provisional application 62/157,004 filed May 5, 2015, the entirety of which is incorporated herein by reference.

FIELD

Embodiments are related to apparatus for clearing debris in a wellbore and, more particularly, to apparatus capable of removing the debris from the wellbore.

BACKGROUND

In the oil and gas industry, following drilling of a vertical or horizontal wellbore into a formation for the production of oil or gas therethrough, the wellbore is typically cased and cemented to line the length of the wellbore to ensure safe control of production of fluids therethrough, to prevent water from entering the wellbore and to keep the formation from "sloughing" or "bridging" into the wellbore.

It is well known that during the running-in of the casing, particularly the production casing, the casing may encounter obstructions in the wellbore, such as created by sloughing of the wellbore wall into the open hole or as a result of the casing pushing debris ahead of the bottom end of the casing along the open hole until it forms a bridge. Such obstructions prevent the advance of the casing and require the open hole to be cleared in order to advance the casing to the bottom of the hole. This is particularly problematic in horizontal wellbores and in sandy formations.

Should the casing string becoming sufficiently engaged in the obstruction, differential sticking may occur, making advancing the casing into the wellbore or removal of the casing from the wellbore extremely difficult.

While casing strings may be rotated to assist with moving past or through an obstruction, high torque created by trying to rotate a long string of casing may result in significant damage to the threads between casing joints and may cause centralizers and the like to drag and ream into the wellbore. Rotation of casing may be an option, albeit fraught with problems, in a vertical wellbore, however rotation of casing in a horizontal wellbore is extremely difficult, if not impossible.

In U.S. Pat. No. 8,973,682, the subject matter of which is fully incorporated by reference herein, Applicant has provided a tool that can clear obstructions within wellbores without the need for rotating the casing string, substantially reducing problems associated with rotating the casing string, including but not limited to torque build along the casing string.

Further, in cased or lined wells, sand and debris continues to be an issue. Obstructions and accumulations of debris can be formed therein. Workover operations are performed to clean the cased wellbore and remove debris therefrom. Workover tools are known in the industry as are chemicals and other means of removing debris, including but not limited to sand, waxes and other debris.

In sandy environments, it is known to use nitrogen gas which is pumped into the wellbore to cause debris, such as from an obstruction, to be removed through the annulus between the casing and the nitrogen delivery tool. The use of nitrogen gas can be prohibitively expensive.

Further, mechanical bailers are also known. The bailer is generally a chamber which is lowered into the wellbore for lifting debris therefrom. Conventional bailers typically comprise a reciprocating pump assembly having a chamber for storage of debris therein. The conventional bailers however utilize hexagonal mandrels in the reciprocating pump which cannot be rotated. The inability to rotate is problematic particularly in horizontal wellbores.

Ideally, what is required is a relatively simple and inexpensive apparatus which can perform the function of Applicant's obstruction-clearing tool and the function of a known reciprocating pump.

SUMMARY

Embodiments of a tool and methods of using same disclosed herein utilize reciprocation of part of the tool to open and close standing and travelling valves for pumping slurry containing debris from a wellbore into the tubing string on which the tool is deployed for storage and removal of the debris from the wellbore. At the same time, the debris is agitated for forming the slurry. In embodiments, the reciprocation of the one part of the tool causes rotation of another part of the tool, the rotation being effective to agitate and form the slurry. Periodically or when a design storage threshold is reached, the tool is tripped out of the wellbore for removal of the debris therefrom.

In one broad aspect, a tool for removing debris from a wellbore, the tool adapted to be connected to a downhole distal end of a tubing string, comprises a tubular sleeve having a sleeve bore extending axially therethrough, bore and a distal end of the sleeve having an agitator connected thereto for engaging the wellbore obstructions for forming a slurry. A tubular mandrel is adapted for connection to the distal end of the tubing string, the mandrel having an axial bore extending therethrough for fluid connection to an axial bore of the tubing string, the mandrel fit concentrically within the sleeve bore for reciprocation therein between an upstroke and a downstroke, the sleeve bore being fluidly connected to the mandrel bore. A helical drive arrangement acts between the mandrel and the sleeve for driving the sleeve axially and rotationally along at least a portion of the mandrel during the downstroke and the upstroke of the mandrel. A one-way standing valve is fluidly connected to a distal end of the sleeve bore; and a one way travelling valve is fluidly connected to the mandrel's bore. During the upstroke of the mandrel, a chamber increases in volume in the sleeve bore and slurry is drawn through the standing valve to the chamber; and during the downstroke of the mandrel, the chamber decreases in volume and the slurry is displaced from the chamber through the travelling valve into the tubing string for storage therein.

In another broad aspect, a workover string for use in clearing debris from a wellbore comprises a tubing string and a tool according to embodiments taught herein fluidly connected to a distal end of the tubing string. A perforated sub is located in the tubing string therebetween, forming a storage bore for storing debris therein.

In a broad method aspect, a method for clearing and removal of debris from a wellbore comprises: running a workover string according to embodiments taught herein having the tool attached to the distal end, into a wellbore until the tool thereon encounters an obstruction in the wellbore. The workover string is reciprocated for agitating the debris for formation of a slurry; and pumping the slurry through the tool for storage in the workover string between the tool and the perforated sub.

In embodiments, the reciprocation rotates a portion of the tool for agitating and forming the slurry.

BRIEF DESCRIPTION OF THE DRAWINGS

FIG. 7B illustrating the helical portion of the grooves formed adjacent a distal end of the mandrel and transitioning from an axial portion of the grooves formed over the remainder of the length of the mandrel for reducing a number of revolutions of the sleeve;

FIG. 7C illustrating the helical portion of the grooves formed adjacent a proximal end of the mandrel and transitioning to the axial portion formed over the remainder of the length of the mandrel for reducing a number of revolutions of the sleeve; and FIG. 7D illustrating the helical portion of the grooves formed at about a midpoint of the mandrel and transitioning from and to the axial portions formed over the remainder of the length of the mandrel for reducing a number of revolutions of the sleeve;

DESCRIPTION

Figure 1:
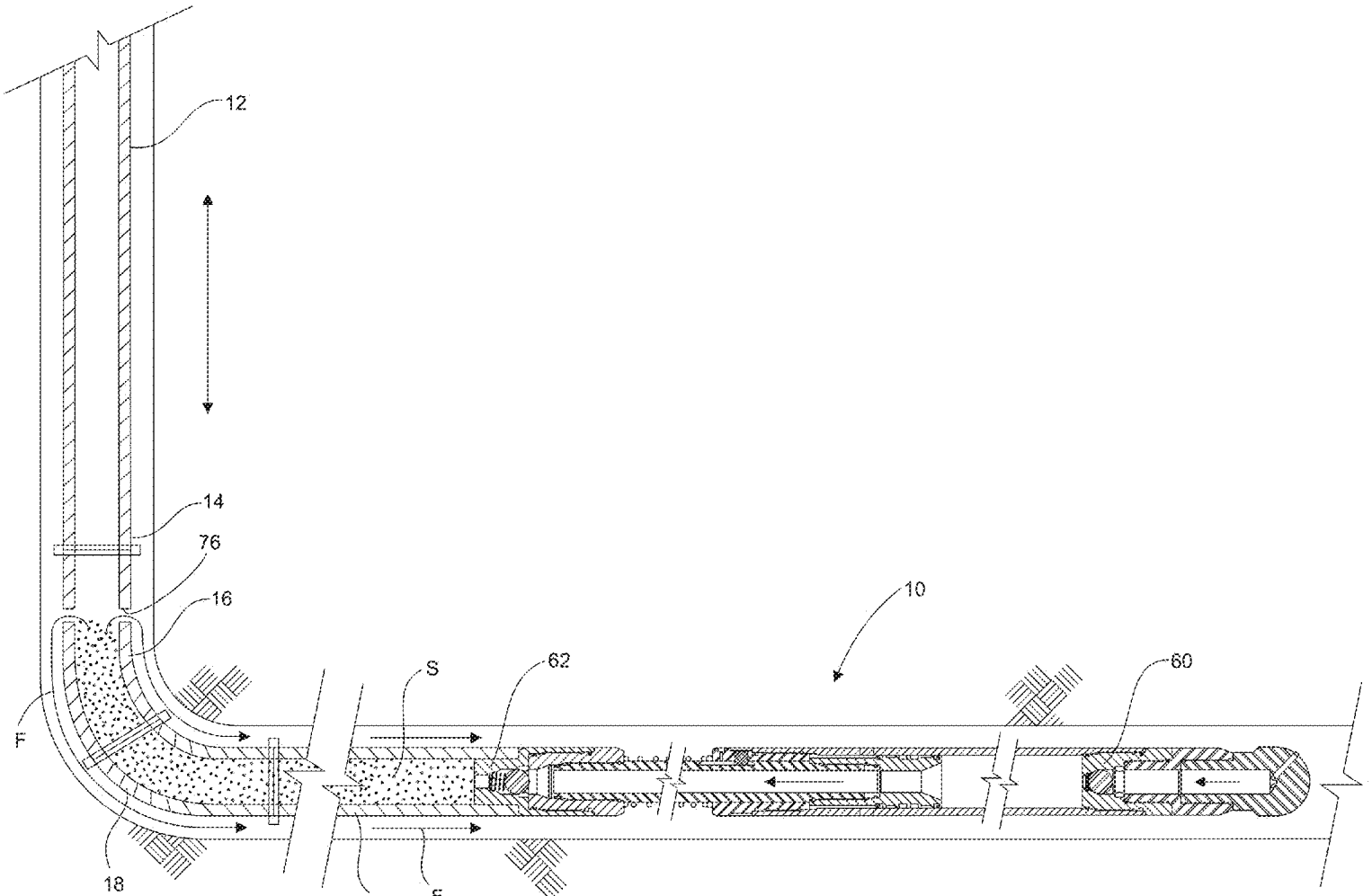
FIG. 1 is an illustration of an embodiment of a tool taught herein, incorporated into a tubing string and deployed into a wellbore for clearing debris therefrom, the tool being connected to a distal end of the tubing string and spaced below a perforated sub, incorporated thereabove in the tubing string.
Figure 2A:
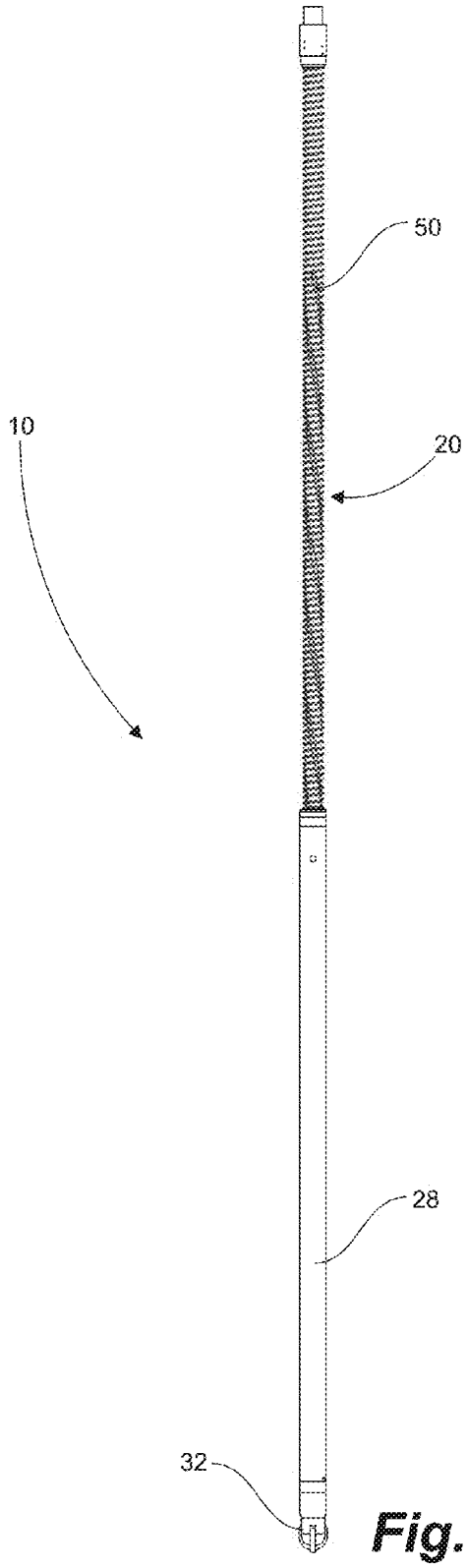
FIG. 2A is a side view of an embodiment taught herein comprising a mandrel, having a spring fit concentrically thereabout, and a tubular sleeve operatively connected to the mandrel, the sleeve having an agitator attached a downhole end and a bore formed therethrough in which the mandrel is reciprocated, the mandrel being illustrated in an upstroke position.
Figure 2B:
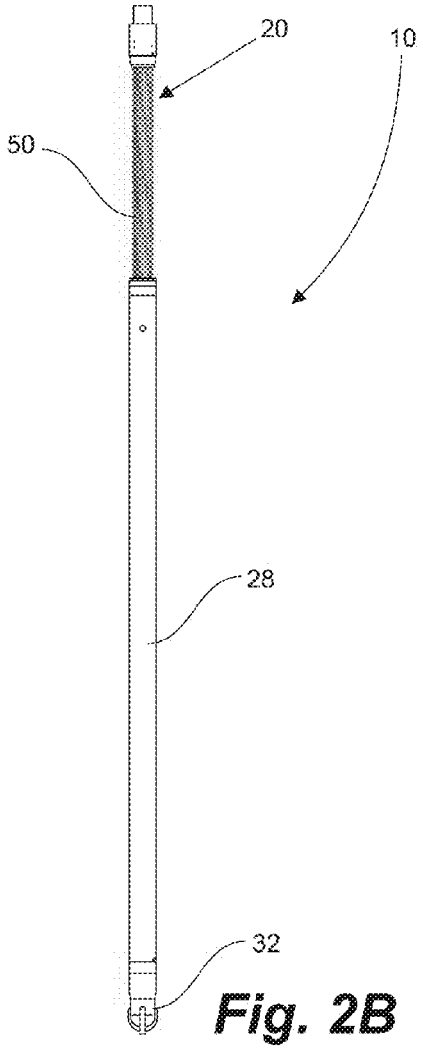
FIG. 2B is a cross-sectional view of the embodiment of the FIG. 1A, illustrating the mandrel in a downstroke position, the spring thereabout being in a compressed state.

It has been recognized that entraining sand in fluid may assist with removal of the debris from a wellbore. Applicant has contemplated attaching a conventional reciprocating pump uphole of embodiments of Applicant's obstruction-clearing tool as taught in U.S. Pat. No. 8,973,682. However, modification of the obstruction clearing tool to add a reciprocating pump has proved not to be a simple combination of known elements, but instead has been a costly process requiring extensive modification of each of the tools to allow them to work cooperatively.

Embodiments of a tool taught herein are deployed into a wellbore using a tubing string. The tool is connected to a distal end of the tubing string for disrupting and removing debris from a cased or lined wellbore.

In an embodiment, Applicant's obstruction-clearing tool, as set forth in U.S. Pat. No. 8,973,682, has been modified to incorporate structural elements of a reciprocating pump: namely a standing valve and a travelling valve. The mandrel of the obstruction tool, axially moveable and sealingly engaged within a bore of a sleeve of the tool, is modified to act as a piston creating suction to draw a slurry comprising debris and wellbore fluid into a chamber formed between the standing valve and the travelling valve during an upstroke of the mandrel. A downstroke of the mandrel closes the standing valve and opens the travelling valve, as is understood in the art, for displacing the slurry from the chamber into the joints of tubing above the travelling valve. Displaced slurry is stored in the tubing string above the travelling valve. Periodically, or when the storage reaches or has been anticipated to reach a threshold, the tool is tripped out of the well and the debris is cleaned from at least the tubing string.

Further, as a result of a helical drive extending between at least a portion of the mandrel and the sleeve, the sleeve and an agitator, such as a drill bit, a fluid jet and the like, connected at a distal end thereof, are caused to rotate for disrupting obstructions in the wellbore, on both the upstroke and the downstroke. The rotation of the agitator at the obstruction forms a slurry of debris therefrom and entrains the debris in the surrounding wellbore fluid. The reciprocating action of the tubing string and mandrel connected thereto, which axially and rotationally drives the tool, is advantageously used to open and close the standing and travelling valves to pump the debris slurry through the bore of the tool and up the tubing string thereabove where it is stored and thereafter removed at surface.

In embodiments, a perforated sub is incorporated into the tubing string, spaced above the tool by joints of tubing. The joints of tubing between the perforated sub and a top of the tool form a storage bore used to collect and store the captured debris. Wellbore fluid collected with the debris slurry is returned to the wellbore through perforations in the perforated sub. Periodically or at a design storage threshold or estimated percentage fill, the tool is tripped out and the debris is removed at surface. Cleanout operations are generally repeated until the obstruction is cleared or until significant amounts of debris are no longer collected.

In an embodiment, when a wellbore obstruction is encountered or engaged downhole, an uphole stroke of the casing string actuates an agitator operatively connected to a downhole end of the tool to rotate in a first direction, thereby creating and agitating debris for forming slurry in wellbore fluid. Concurrently, as the uphole stroke causes a mandrel to move in an uphole direction, suction is created within the bore of the tool for intaking the slurry containing the debris through ports in the agitator and into a cavity in the tool created in the tool by the axial upstroke movement of the mandrel. The debris is temporarily retained in the chamber throughout the upstroke of the mandrel.

The downhole stroke of the mandrel causes the sleeve and attached agitator to rotate in a second, opposite direction, further creating debris from the obstruction and agitating the debris and wellbore fluid for forming the slurry. The downstroke moves the mandrel toward the standing valve, causing the standing valve to close and the travelling valve to open, as described below in greater detail, to displace the retained slurry in the chamber therethrough to be stored in the joints of tubing thereabove. As additional debris is pumped into the joints of tubing thereabove, wellbore fluid is caused be displaced through the perforations in the perforated sub, returning the fluid to the wellbore.

Thus, repeated reciprocal stroking of the tubing string between the upstroke and the downstroke causes the agitator located at the obstruction or accumulation, to rotate alternately between the first direction and the second direction for creating debris in both cases. At the same time, in the upstroke, the slurry of debris and wellbore fluid is pumped into the tool and, in the downstroke, the debris within the tool is displaced into the tubing string thereabove for storage therein until periodically removed when the tool is tripped to surface.

With reference to FIG. 1, and in greater detail, an embodiment of the tool 10 is incorporated into a tubing string 12, at a distal end 14 thereof. Spaced above the tool 10, a perforated sub 16 is incorporated into the tubing string 12. Joints of tubing 18, located between the tool 10 and the perforated sub 16 are used to store collected debris D therein.

As shown in FIGS. 1, 2A, 2B, 3A and 3B, in an embodiment, the tool 10 comprises a tubular mandrel 20 having a mandrel bore 22 formed axially therein. An uphole, proximal end 24 of the mandrel 20 is adapted to be fluidly connected to the downhole, distal end 14 of the tubing string 12. The mandrel bore 22, fluidly connected to a bore 26 of the tubing string 12, forms a contiguous bore therewith.

A tubular sleeve 28, having a sleeve bore 30 formed axially therethrough is fit over the mandrel 20 and fluidly connected thereto. The mandrel 20 is reciprocated axially within the sleeve's bore 30 between an upstroke and a downstroke. Further, the connection between the sleeve 28 and the mandrel 20 causes the sleeve 28 to rotate during each of the upstroke and downstroke of the mandrel 20. An agitator 32, such as a drill bit, a fluid jet and the like, is connected to a distal end 34 of the sleeve 28 for engaging the obstructions or accumulations of debris and causing debris D therefrom to be entrained in wellbore fluid F for forming a slurry S therewith. The agitator 32 further comprises fluid ports 36 which are fluidly connected to the sleeve bore 30.

The connection between the mandrel 20 and the sleeve 28 comprises a helical drive arrangement 40 which causes the sleeve 28 to rotate as the mandrel 20 is reciprocated therein. The helical drive 40 comprises helical grooves 42 and corresponding pins 44 acting between the mandrel 20 and the sleeve 28, for guiding the sleeve 28 rotationally about the mandrel 20 when the mandrel 20 is reciprocated.

In an embodiment, the helical grooves 42 are formed on an outer surface 46 of the mandrel 20 and the pins 44 are fixed to an inner surface 48 of the sleeve 28.

In embodiments, as shown in FIGS. 2A, 2B, 3A, 3B, a biasing member 50 acts between the non-rotating mandrel 20 and the rotating sleeve 28 to add impetus for the sleeve 28 to remain engaged with the obstruction, during the upstroke of the mandrel 20. This is particularly useful in horizontal wellbores in which gravity does not aid in urging the sleeve 28 downhole. In embodiments, the outer biasing member is a spring 50, fit concentrically about the mandrel 20 which acts to bias the sleeve 28 axially away from the mandrel 20 in the upstroke. As shown, and to mitigate the effects of a resisting torque imparted by the spring 50, the tool 10 comprises slip bushings 52 fit between a proximal end 54 of the sleeve 28 and the spring 50.

Having reference to FIGS. 3A to 3D, a standing valve 60, such as a one-way ball valve, is fluidly connected to the sleeve bore 30 at the distal end 34 of the sleeve 28, uphole of the agitator 32. A travelling valve 62, such as a one-way ball valve, is fluidly connected to the proximal end 24 of the mandrel 20. A sealing sub 64 is connected to a distal end 66 of the mandrel 20. The sealing sub 64 comprises a tubular housing 68 having seals 70 fit to an outer surface 72 thereof for engaging the inner surface 48 of the sleeve 28. The sealing sub 64 acts much like a piston to create suction within a chamber 74 formed in the sleeve bore 30 during the upstroke of the mandrel 20. The chamber 74 increases in volume during the upstroke of the mandrel 20.

Rotation of the sleeve 38 and agitator 32 produces slurry S. The slurry S produced adjacent the agitator 32 is drawn into the fluid ports 36 in the agitator 32. The upstroke of the mandrel 20 opens the standing valve 60, permitting the slurry S to pass therethrough into the chamber 74. In the downstroke, the standing valve 60 closes and the travelling valve 62 opens. As the chamber 74 reduces in size, the slurry S is displaced into the joints of tubing 18 between the travelling valve 62 and the perforated sub 16. As the joints of tubing 18 fill with slurry S, wellbore fluid F therefrom is delivered back to the wellbore through perforations 76 in the perforated sub 16 and the debris D is retained therein. Periodically the tool 10 is tripped to surface for removal of retained debris D from the joints of tubing 18.

Figure 4B:
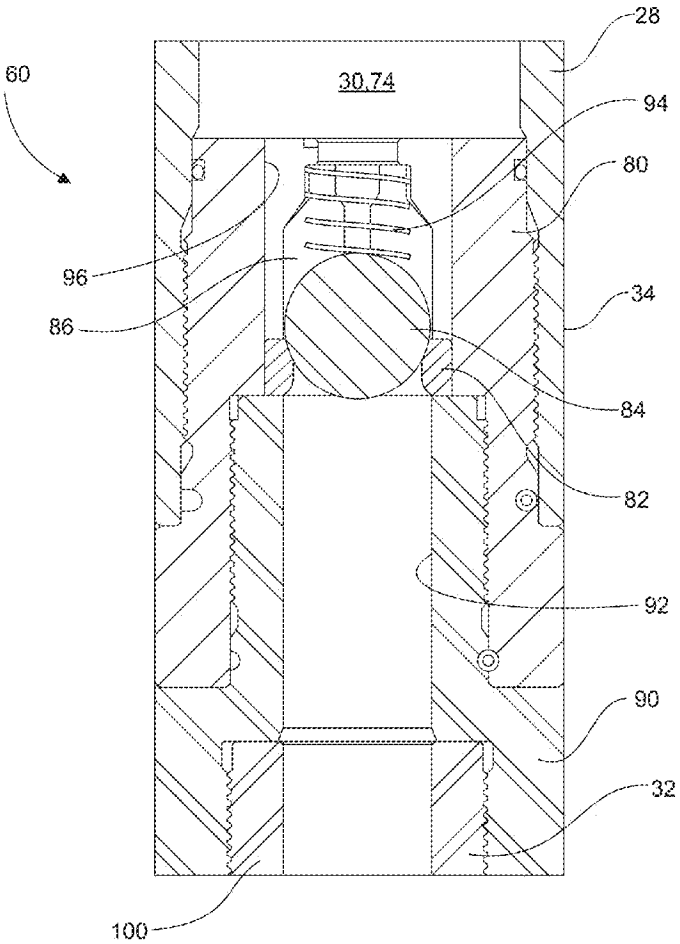
FIG. 4B is a detailed side cross-sectional view of the standing valve of FIG. 3B in the closed position.
Figure 4A:
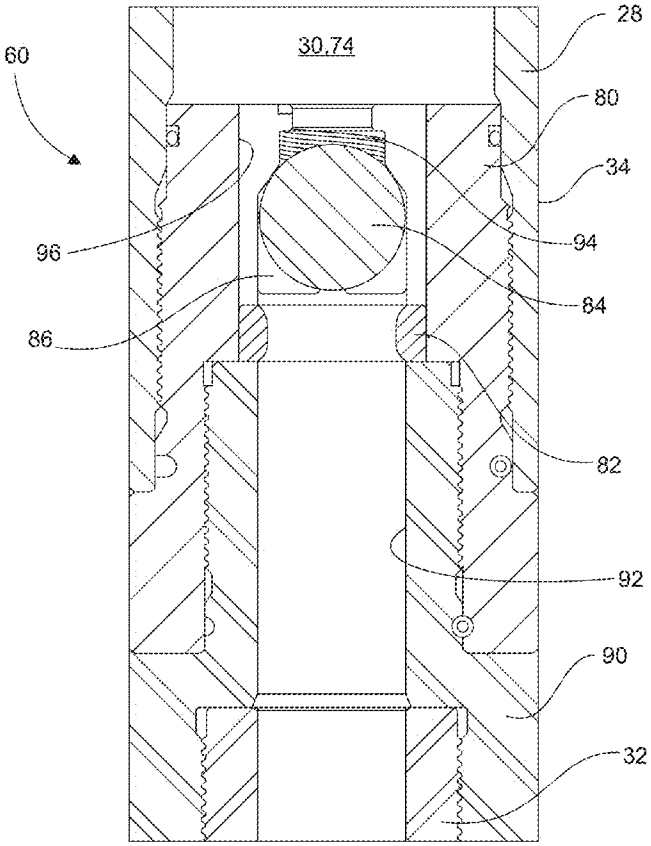
FIG. 4A is a detailed side cross-sectional view of the standing valve of FIG. 3A in the open position.

With reference to FIGS. 4A and 4B, in embodiments, the standing valve 60 is a one-way ball valve comprising a ball cage 80, a ball seat 82 and a ball 84. The ball cage 80 has an axial bore 86 therethrough for housing ball 84 therein. The cage bore 86 is fluidly connecting to the agitator 32 and the sleeve bore 30 in which the chamber 74 is formed. In embodiments, the ball cage 80 is connected to the distal end 34 of the sleeve 28, such as by a threaded connection thereto. A tubular connecting sub 90, having a bore 92 formed therethrough, is threaded between the ball cage 80 and the agitator 32. The connecting sub bore 92 and cage bore 86 are contiguous with the sleeve bore 30 and chamber 74 and are fluidly connected to the agitator's fluid ports 36.

In embodiments, particularly for use once again in horizontal wellbores, a biasing member 94, such as a spring, is housed in the ball cage 80 to act between the cage 80 and the ball 84 for biasing the ball 84 to a closed position wherein the ball 84 engages the ball seat 82.

Thus, as shown in FIG. 4B, in the closed position the spring 94, biases the ball 84 to seat against the ball seat 82, preventing the passage of slurry S from within the sleeve chamber 74 to the agitator's fluid ports 36.

As shown in FIG. 4A, when the volume of chamber 74 is expanding and suction is applied during the upstroke of the mandrel 20, the biasing spring 94 is overcome and the ball 84 is lifted from the ball seat 82 to an open position. In the open position, slurry S is allowed to enter the agitator's fluid ports 36 into the bore 92 of the connecting sub 90, pass through the cage bore 86, bypassing the ball therein and into the sleeve chamber 74.

With reference again to FIGS. 4A and 4B, the ball cage 80 further comprises one or more passageways 96 fluidly connected to the bore 92 for permitting the flow of slurry S to bypass the ball 84 to reach the chamber 74 in the open position.

Figure 5A:
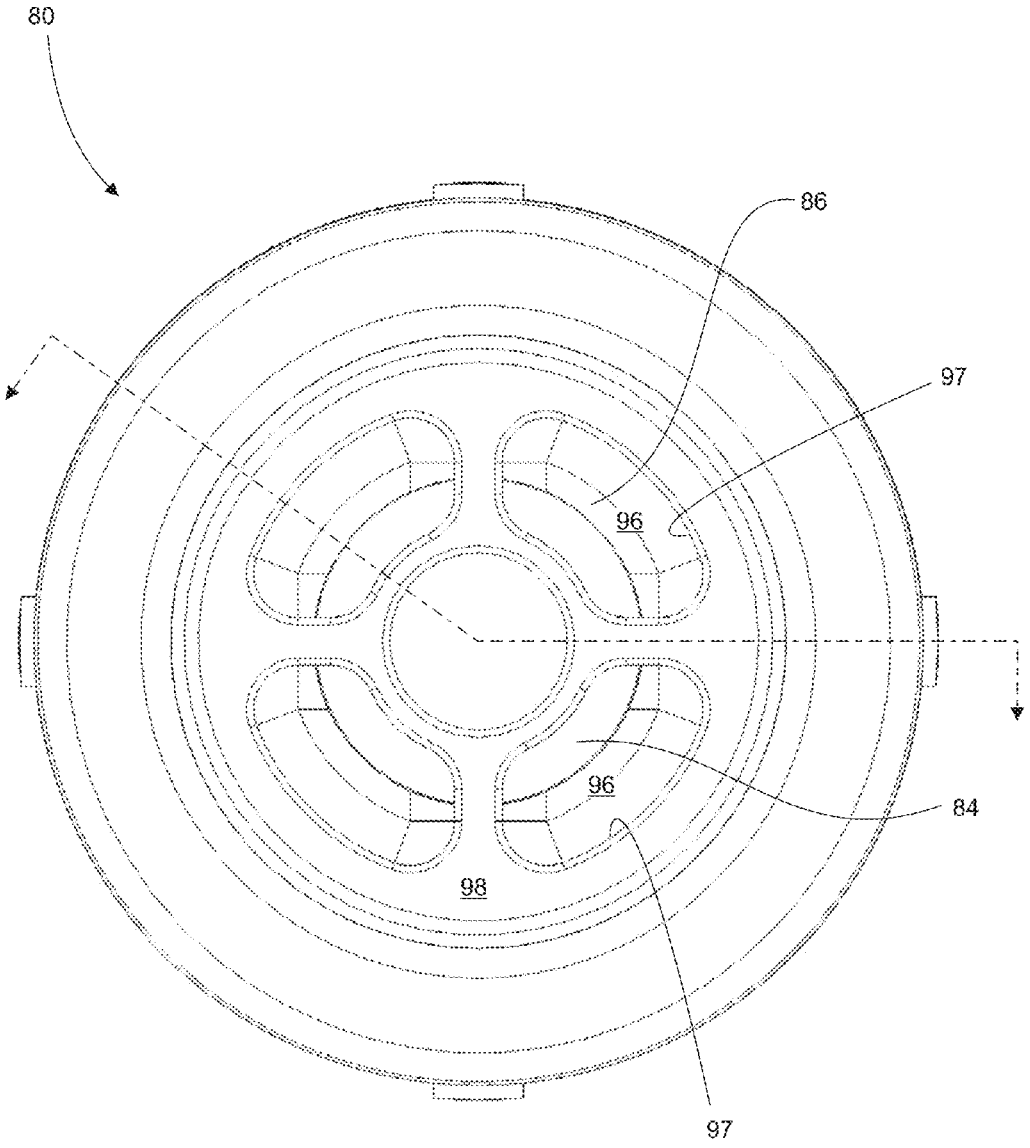
FIG. 5A is a plan view of a ball cage of the standing valve of FIG. 4A, illustrating passageways for permitting passage of materials therethrough.
Figure 5B:
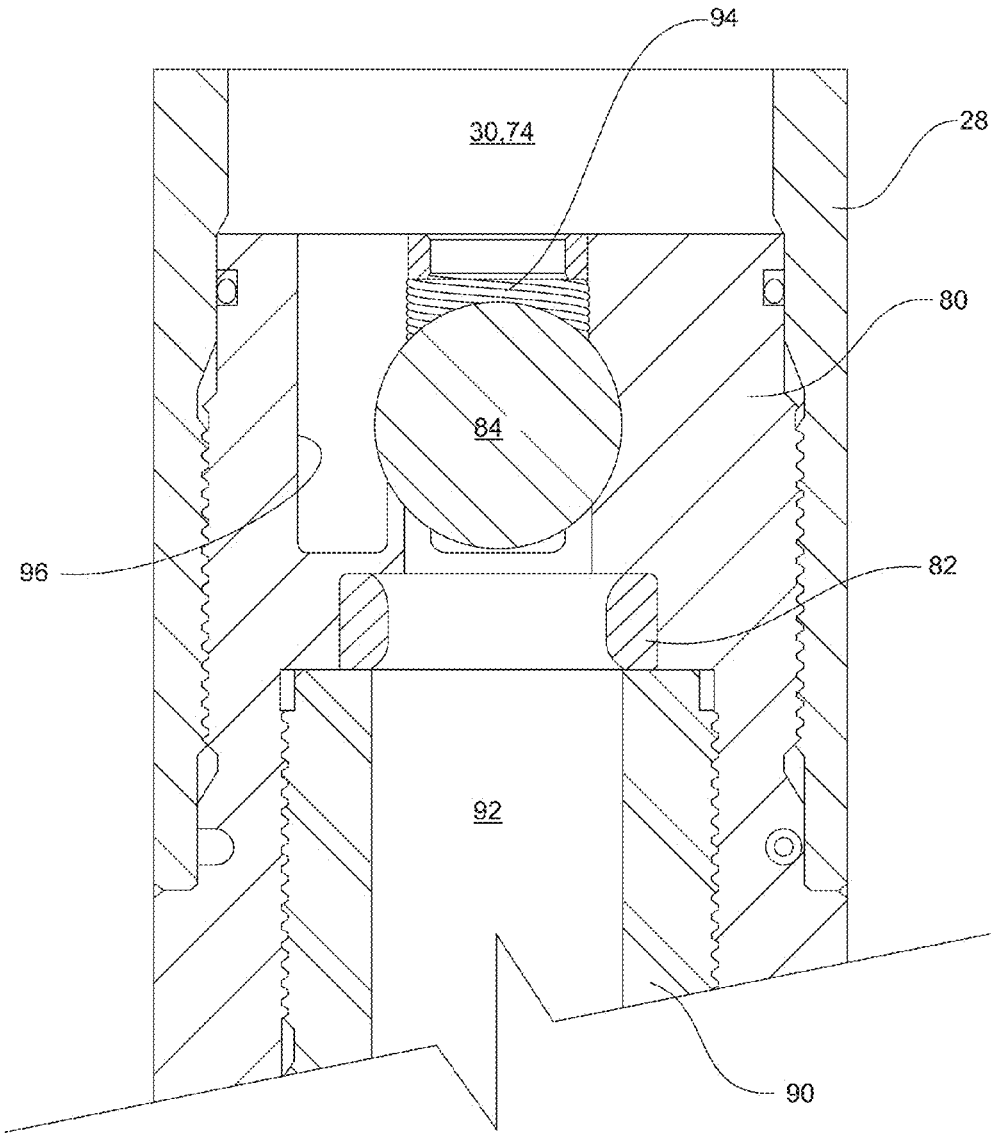
FIG. 5B is a side cross-sectional view of the cage of the standing valve of FIG. 4A, illustrating the passageways.

As shown in FIGS. 5A and 5B, the ball cage 80 comprises four passageways 96 which extend through ports 97 in a top 98 of the ball cage 80.

Figure 5C:
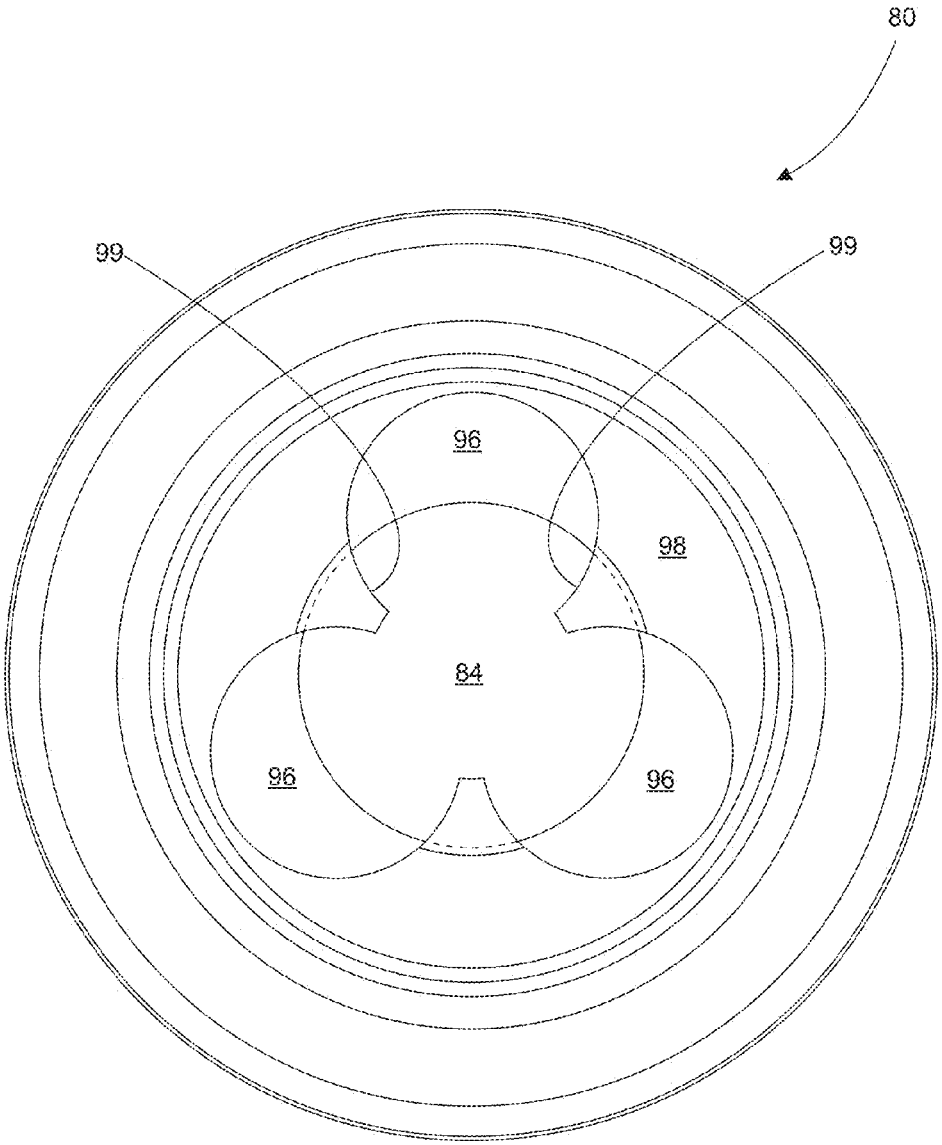
FIG. 5C is a plan view of a ball cage of the standing valve of another embodiment having three passageways combining to form a substantially open top of the ball cage, fingers extending into the open top between the passageways for retaining the ball therein.

As shown in FIG. 5C, the ball cage 80 comprises three passageways 96 forming an open top 98 having fingers 99 extending into the open top 98 for retaining the ball 82 therein.

Other arrangements are possible including an embodiment wherein the ball 84 and ball seat 82 are offset within the ball cage 80 to create one or more larger fluid passageways (not shown) to allow slurry S to pass therethrough in the open position.

The travelling valve 62, connected to the proximal end 24 of the mandrel 20 comprises substantially the same structural elements, numbered herein using the same reference numerals.

Figure 6A:
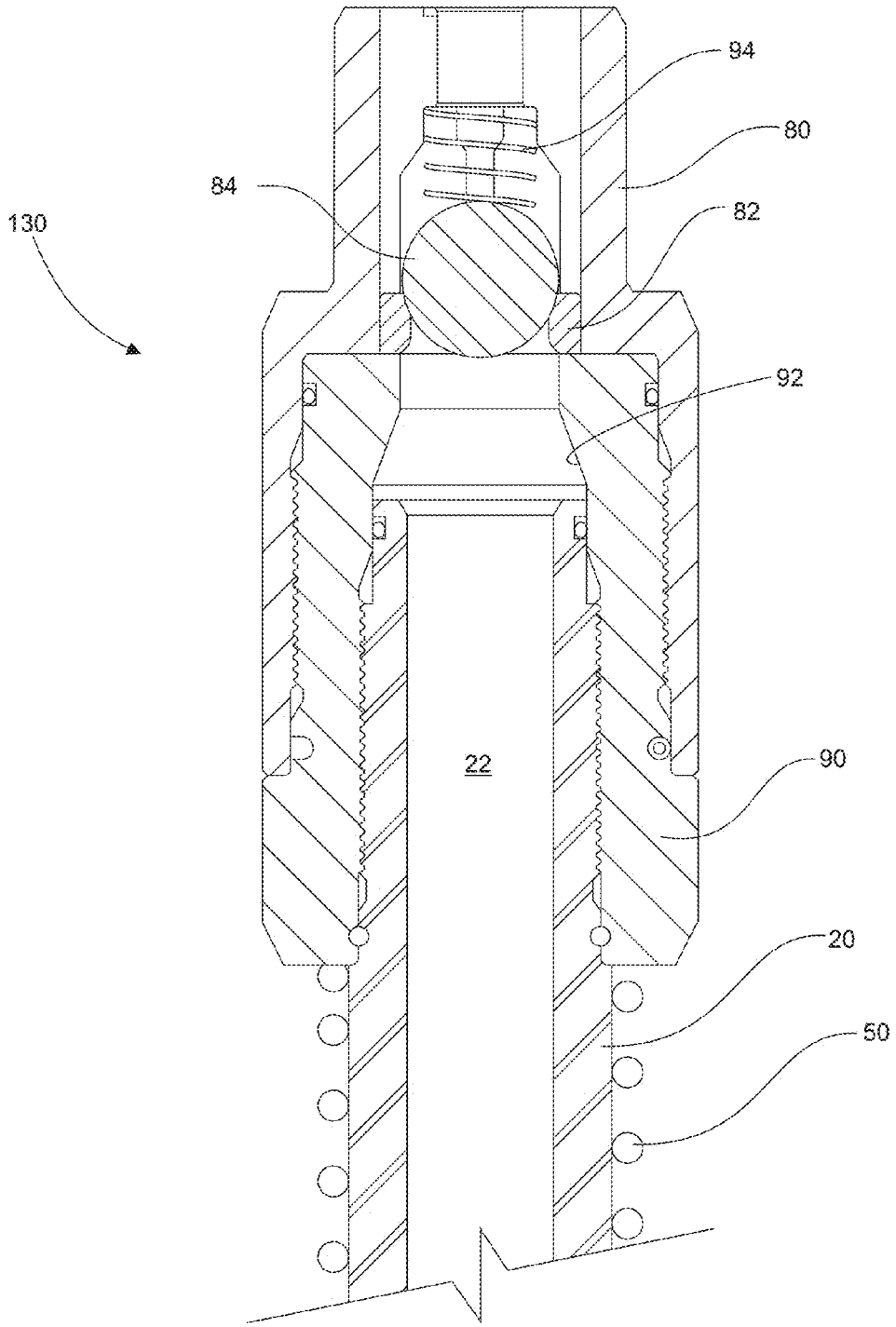
FIG. 6A is a side cross-sectional view of the travelling valve illustrating a ball, a ball seat and a spring, the spring biasing the ball to seat against the ball seat.
Figure 6B:
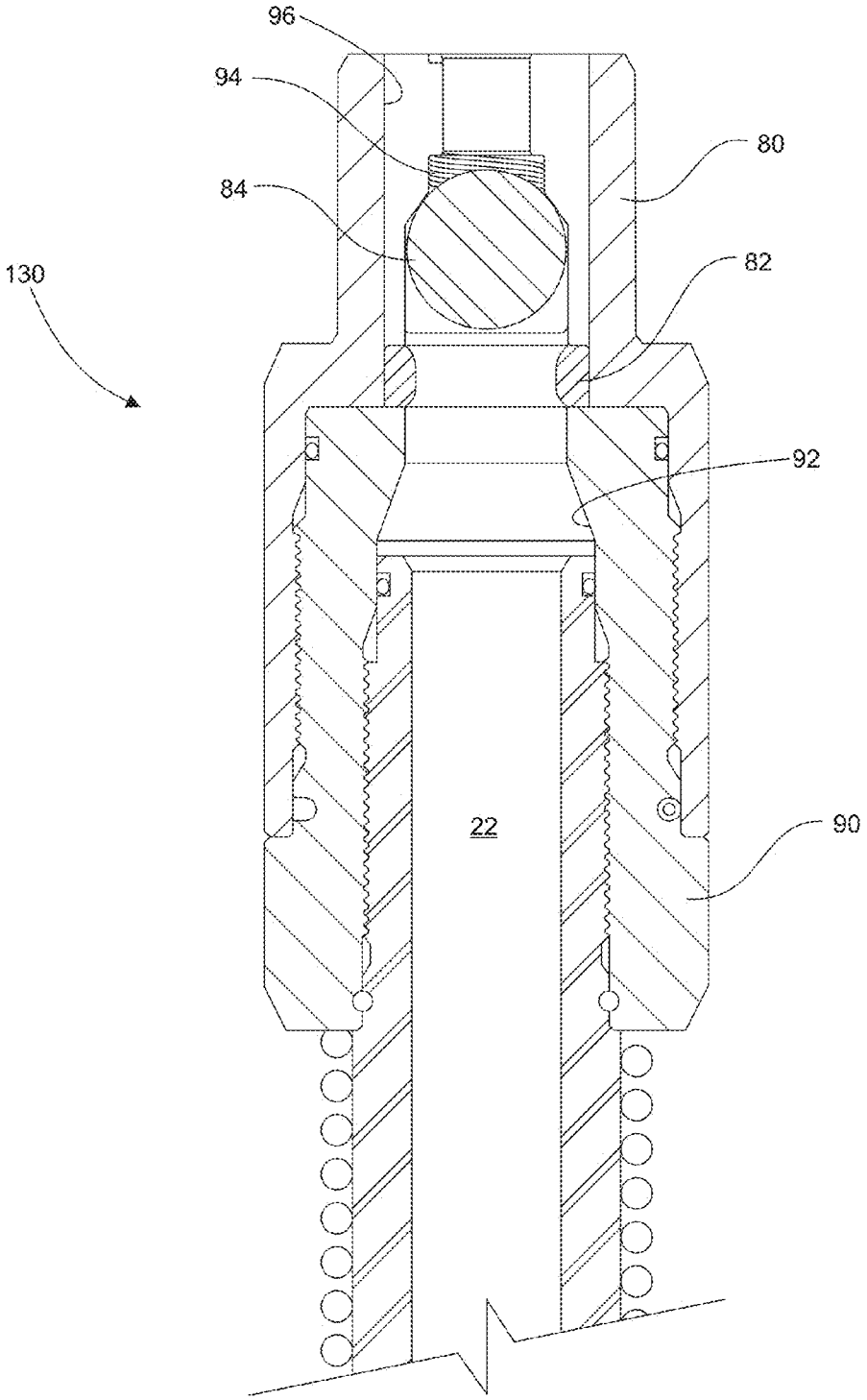
FIG. 6B is a side cross-sectional view of the travelling valve of FIG. 5A, illustrating the ball lifted from the ball seat and overcoming the biasing spring to permit the flow of slurry thereby.

Having reference to FIGS. 6A and 6B, however, the traveling valve 62 is biased to the closed position on the upstroke of the mandrel 20 to prevent the passage of slurry S, through the mandrel bore 22, from the chamber 74 to the tubing string 12, when the standing valve 60 is in the open position for filling the chamber 74 with slurry S.

Having reference again to FIGS. 3B and 3D, during the downstroke of the mandrel 20, the volume of the chamber 74 diminishes. The standing valve 60 is in the closed position, preventing the passage of slurry S in the chamber 74 therethrough to the agitator 32, and slurry S is displaced through the travelling valve 62. When sufficient force is applied to the ball 84, by the slurry S within the chamber 74, the biasing spring 94 of the travelling valve 62 is overcome and the ball 84 is lifted from the ball seat 82 to the open position, allowing the slurry S to bypass the ball 84 through the passageways 96 to enter the joints of tubing 18 between the travelling valve 62 and the perforated sub 16 for storage therein.

In embodiments, Applicant controls the turbulence associated with rotation of the sleeve 28 and agitator 32 to avoid or minimize forming slurry S having a solids content that may compromise operation of the tool 10, such as by packing within the chamber 74 and/or the standing and travelling valves 60,62.

Turbulence can be reduced by reducing the agitation provided by the sleeve 28 or when the agitation is applied. In an embodiment, agitation is reduced by decreasing the number of revolutions of the sleeve 28 during the upstroke and downstroke.

Figure 7A:
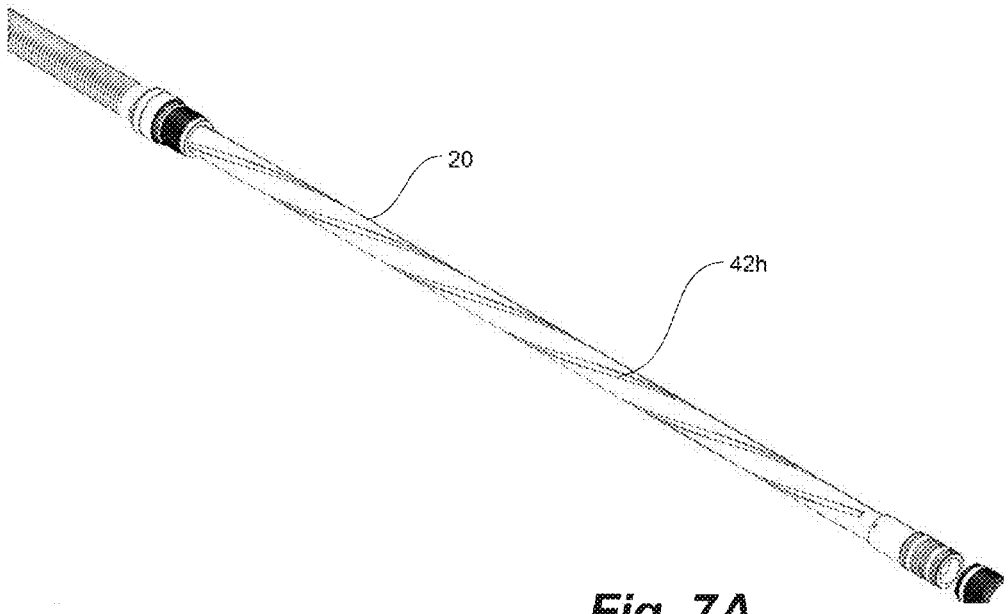
FIGS. 7A to 7D are perspective views of grooves on an outer surface of the mandrel forming part of a helical drive arrangement for engaging pins on an inner surface of the sleeve, the pins, sleeve and an outer spring having been removed for clarity, more particularly, FIG. 7A illustrating a helical portion of grooves formed along an entirety of a length of the mandrel for causing rotation of the sleeve.

Having reference to FIG. 7A, in the case where the grooves 42 extend helically the full length of the mandrel 20, the sleeve 28 may, for example, make about four full revolutions during each of the upstroke and the downstroke.

Figure 7B:
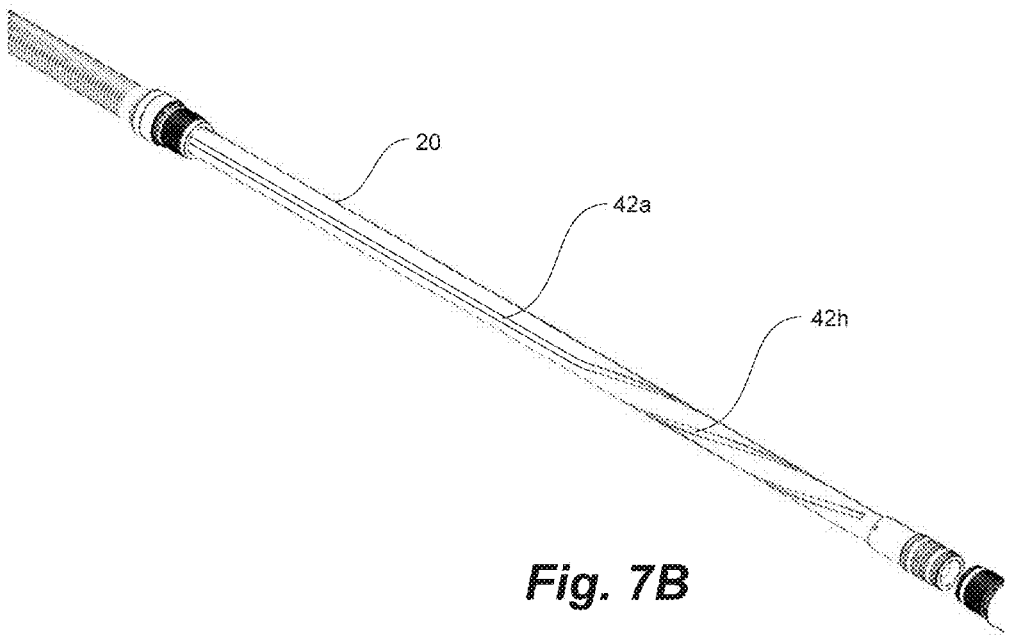
Figure 7C:
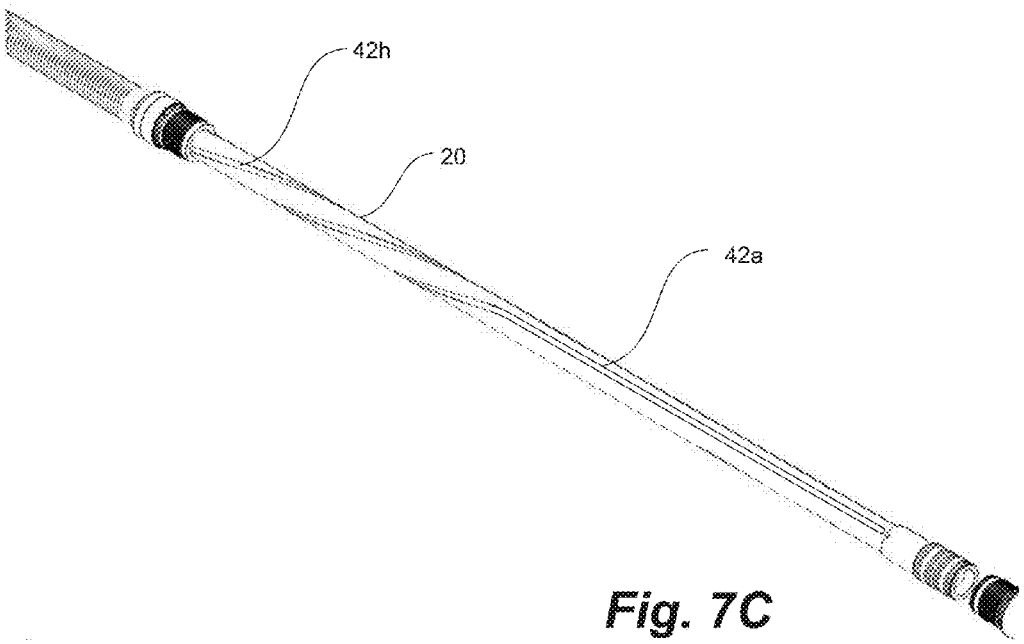
Figure 7D:
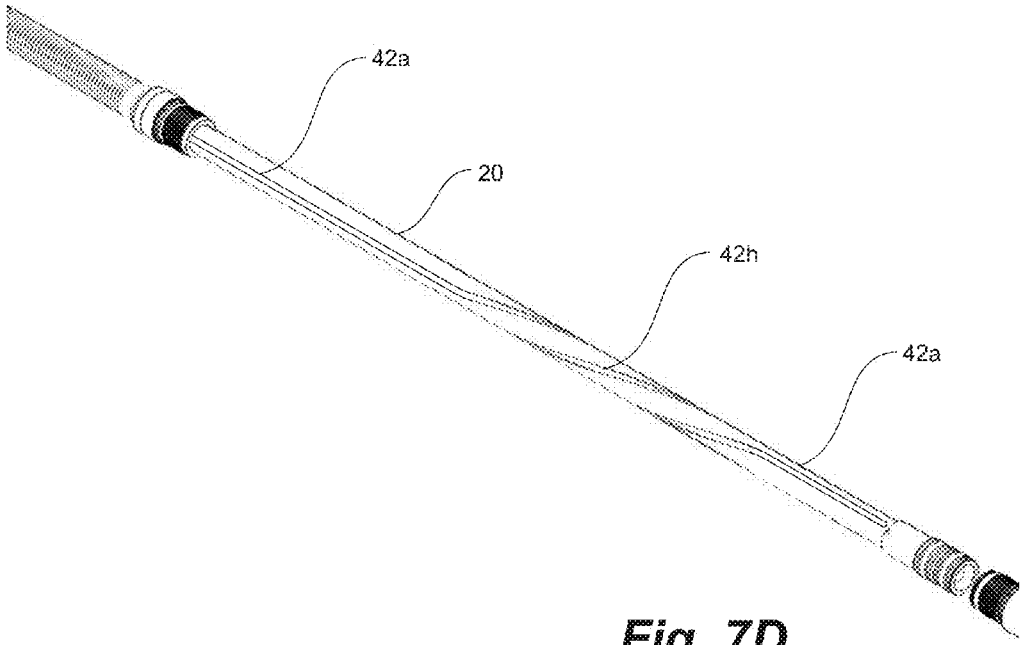

As shown in FIGS. 7B, 7C and 7D, in embodiments taught herein, agitation at the agitator 32, which results in formation of the slurry S, is reduced by reducing a length of the helical portion 42*h* of the grooves 42 in the helical drive 40 and thereby reducing the rotational agitation by at least about ½. The helical portion 42*h* of the grooves 42 thus extends along only a portion of the mandrel 20, for example a length sufficient to cause the sleeve 28 to rotate from about ¾ to 1 full revolution. The grooves 42 transition from the helical portion 42*h* to an axially extending portion 42*a* over a remainder of a length of the mandrel 20. The transition gradually alters the angle or pitch of the helical portion 42*h*, as the helical portion 42*h* enter the contiguous axial portion 42*a*.

Figure 3A:
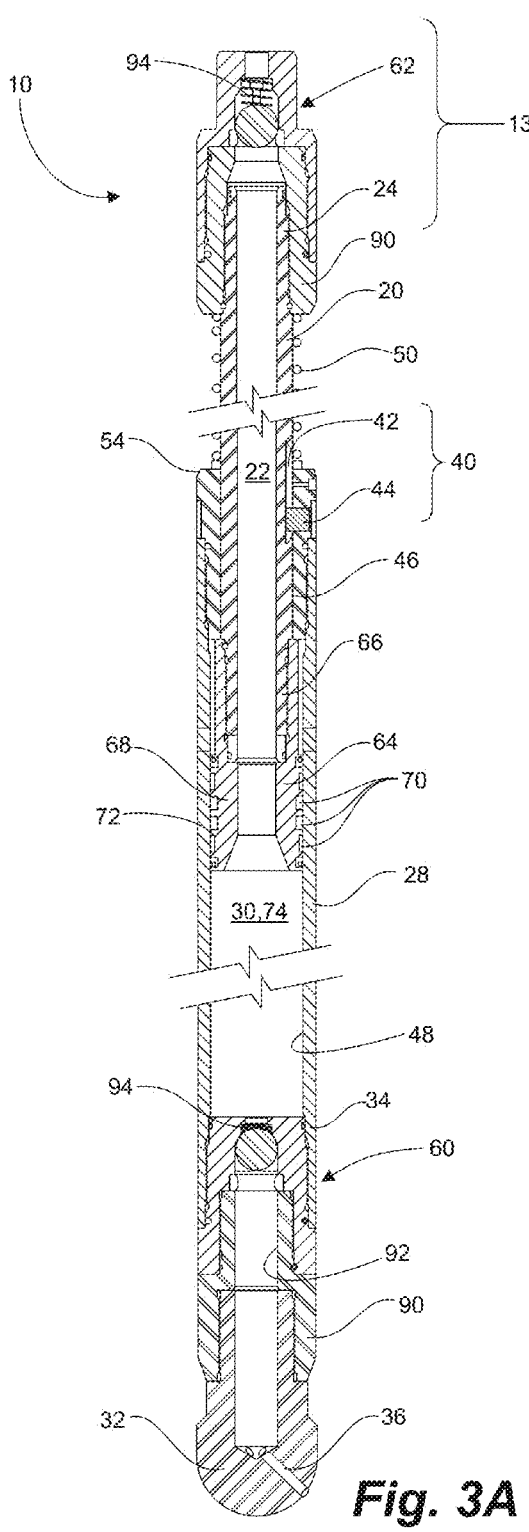
FIG. 3A is a cross-sectional view according to FIG. 2A, the mandrel being in the upstroke, a standing valve being open for admitting a flow of slurry into a chamber defined by a bore of the sleeve and a travelling valve being closed for retaining the slurry in the chamber.
Figure 3B:
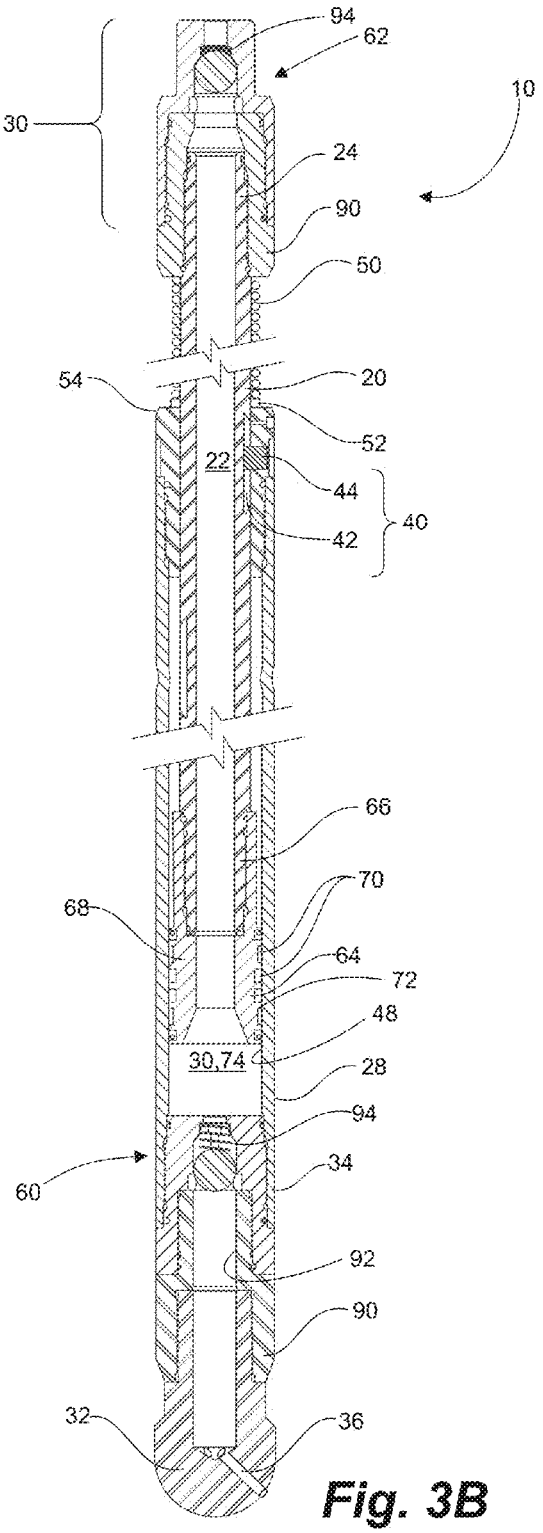
FIG. 3B is a side cross-sectional view according to FIG. 2B, illustrating the mandrel in the downstroke within the sleeve, the standing valve being closed and the travelling valve being open for displacing the slurry from the chamber into joints of tubing thereabove.
Figure 3C:
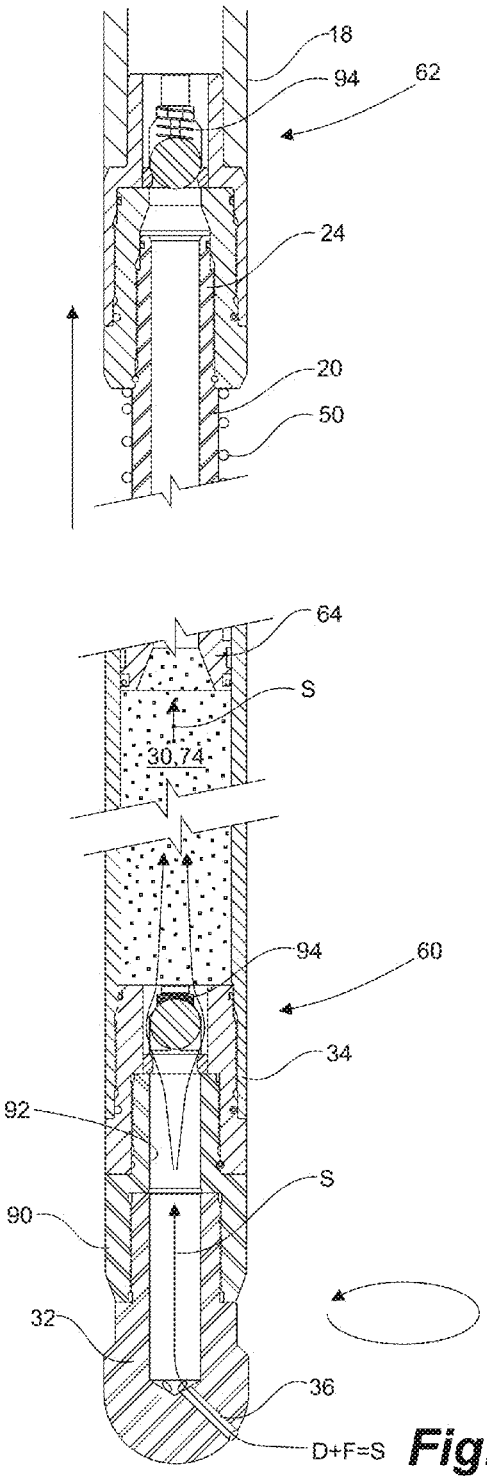
FIG. 3C is a partial sectional view according to FIG. 3A illustrating the open standing valve and the closed travelling valve and the flow of slurry through the tool.
Figure 3D:
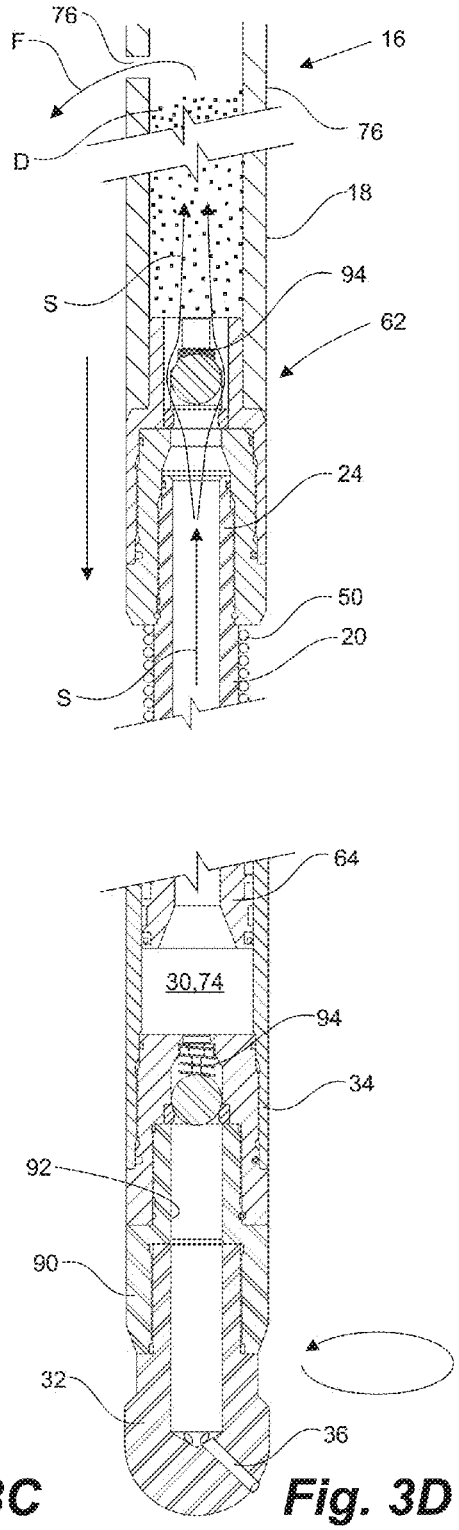
FIG. 3D is a partial sectional view according to FIG. 3B illustrating the closed standing valve and the open travelling valve and the flow of slurry through the tool and into the joints of tubing and further, return of wellbore fluid therefrom through the perforated sub.

In an embodiment, as shown in FIG. 7B, positioning the helical portion 42*h* in a portion of the mandrel 20 adjacent the distal end 66 of the mandrel 20 results in the formation of the slurry S at an end of the mandrel's downstroke and immediately prior to the transition to the upstroke (FIG. 3B). The slurry S is thus drawn into the drill agitator's fluid ports 36 shortly following formation thereof, thereby minimizing time in which debris D might settle from the slurry S. Where the helical portion 42*h* of the grooves 42 is located adjacent the proximal end 22 of the mandrel 20 (FIG. 7C), the slurry S has a greater duration before ingestion. Alternatively, the helical portion 42*h* may be located at about a midpoint along the mandrel 20. (FIG. 7D). Agitation early in the upstroke, versus later can control the characteristics of the slurry S drawn into the chamber 74.

An optimal length and location of the helical portion 42*h* of the grooves 42 may vary from wellbore to wellbore or operation to operation depending upon the nature of the debris D, viscosity of the wellbore fluids F, wellbore temperature and the like.

Debris D, temporarily stored in the slurry S in the chamber 74, may undergo a measure of settling within the chamber 74. Further, at the bottom of the downstroke, the sealing sub 64 is spaced above the standing valve 60. Reciprocation of the mandrel 20 may not be sufficient to keep debris D fluid in the bottom end of the chamber 74, particularly adjacent the standing valve 60. If a sufficient amount of debris D packs within the chamber 74, operation of the tool 10 may be compromised as the standing valve 60 may not reliably open or close.

Figure 8:
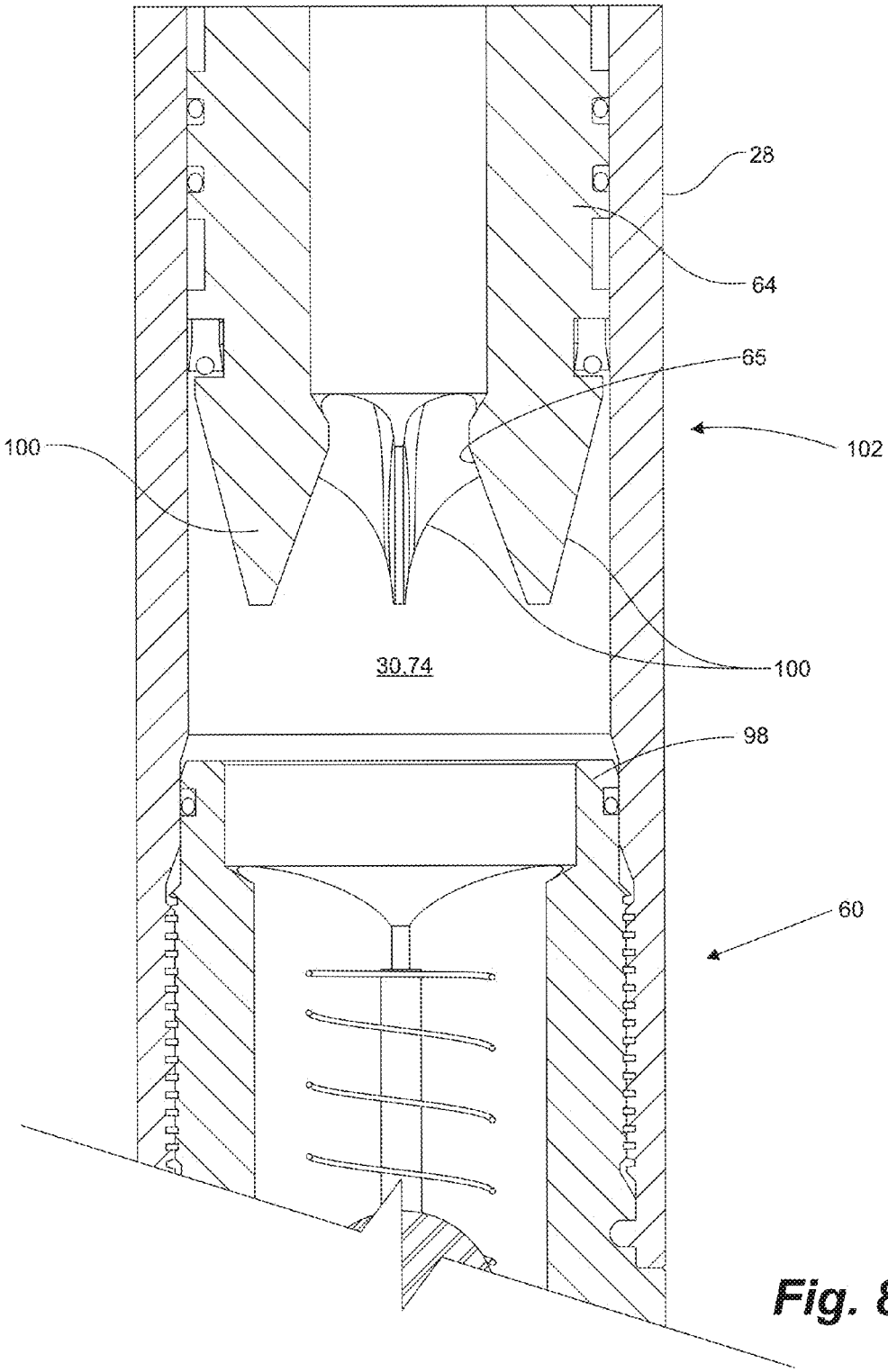
FIG. 8 is a partial sectional view of an embodiment of the tool having one or more axially extending vanes formed at a distal end of a sealing sub, connected to the distal end of the mandrel, for disrupting debris settled above the standing valve when engaged therewith at an end of the mandrel's downstroke.

In embodiments, as shown in FIG. 8, one or more vanes 100 extend axially from a distal end 102 of the sealing sub 64. The vanes 100 engage debris D which may have settled within the chamber 74, adjacent the top 98 of the standing valve 60. As the mandrel 20 reaches an end of the downstroke, the vanes 100 engage any settled debris D in the chamber 74. Depending upon the timing of the helical portion 42*h* of the grooves 42, rotation of the sleeve 28 on the downstroke and the upstroke causes the settled debris D, engaging the vanes 100, to be disrupted and entrained with slurry S entering into the chamber 74. The vanes 100 may also extend radially inwardly into a bore 65 of the sealing sub 64.

Figure 9:
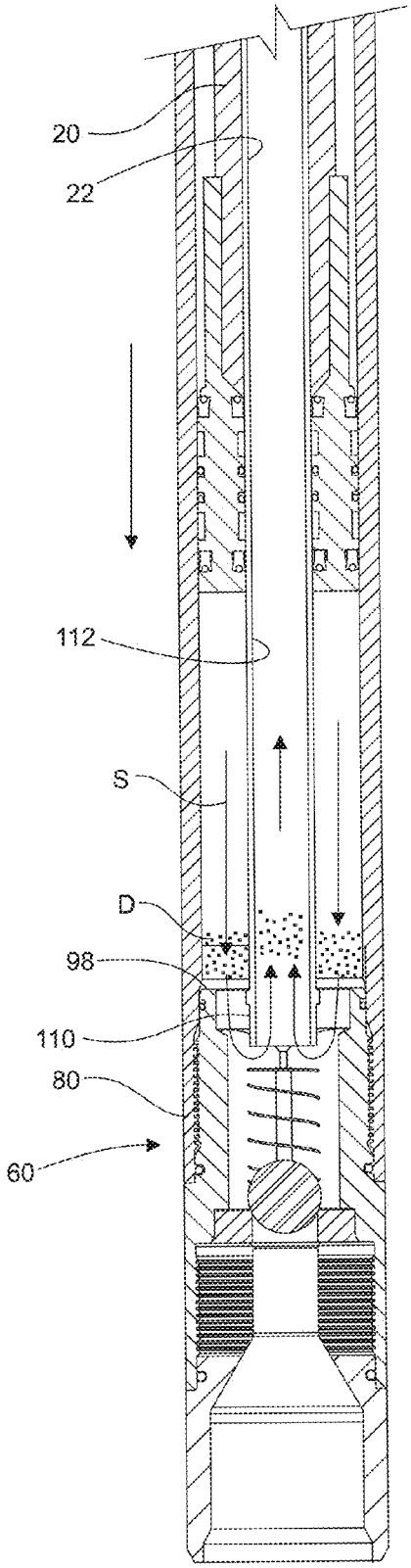
FIG. 9 is a partial sectional view of an embodiment of the tool having a velocity tube fit to the bore of the mandrel and sealing sub and extending axially therefrom to adjacent a top of the standing valve, fluid displaced by the sealing sub being directed in an annulus between the velocity tube and the sleeve toward debris settled above the standing valve, the fluid disrupting the debris which is entrained therein and carried into a bore of the velocity tube for delivery to the travelling valve.

In an alternate embodiment so as to address debris D at the standing valve 60, as shown in FIG. 9, a velocity tube 110 is fit sealingly to the bore 22 of the mandrel 20. The tube 110 extends axially downhole through the bore 22 of the mandrel 20 and the distal end 102 of the sealing sub 64 to a point adjacent the top 98 of the standing valve's ball cage 80. The tube 110 is fixed axially with respect to the standing valve 60. The mandrel 20 reciprocates both within the sleeve 28 and about the tube 110. During the downstroke of the mandrel 20, instead of collected slurry S being pumped out serially from the top of the collected debris D as approached by the sealing sub 64, the slurry S in the chamber 74 between the tube 110 and the inner surface of the sleeve 28 is caused to flow oppositely toward the top 98 of the ball cage 80. As the standing valve 60 is in the closed position during the downstroke, the slurry S scours the bottom of the chamber 74 and enters a bore 112 of the tube 110 for delivery to the bore 22 of the mandrel 20 and the travelling valve 62, as discussed above. The slurry S, directed in a U-shaped flowpath, engages at least some of the settled debris D at the top 98 of the ball cage 80 and entrains the debris D for delivery to the travelling valve 62 thereby minimizing settling and packing of debris D adjacent the top 98 of the standing valve 60.

In an embodiment, the travelling valve 62 can be located in the bore 112 of the velocity tube 110, such as at an uphole end thereof.

Use of a tool 10 according to this embodiment may require additional reciprocation of the mandrel 20 to clear an equivalent volume of debris D, when compared to other embodiments taught herein, as a result of the reduced volume of the chamber 74 having the tube 110 located therein.

In Operation

The tool 10, according to an embodiment taught herein, is incorporated at the distal end 14 of the tubing string 12, such as a workover string and is run into the wellbore. In embodiments, the perforated sub 16 is spaced above the travelling valve 62 by one or more joints of tubing 18. When the tool 10 contacts an obstruction or accumulation of debris within the wellbore, the mandrel 20 is reciprocated within the sleeve 28, in either of an upstroke or a downstroke of the tubing string 12 and mandrel 20 followed by a stroke of the tubing string 12 and mandrel 20 in the opposite direction. The pins 44 engaged in the helical portion 42*h* of the grooves 42 in the helical drive 40 cause the sleeve 28 and the agitator 32 on the distal end 34 of the sleeve 28, in contact with the obstruction, to rotate for forming the slurry S of the debris D. Reciprocation is repeated until the obstruction or accumulation is cleared.

On the upstroke, the outer biasing spring 50 biases the sleeve 28 away from the mandrel 20 to aid in maintaining the sleeve 28 and the agitator 32 in engagement with or adjacent to the obstruction as the tubing string 12 and mandrel 20 move away, uphole, therefrom. Having the helical portion 42*h* of the grooves 42 adjacent the downhole end and during the upstroke of the mandrel 20, the helical drive 40 causes the sleeve 28 to rotate in the first direction for disrupting debris and forming the slurry S. Further, the upstroke of the mandrel 20 increases the volume of the chamber 74 creating suction therein for opening the standing valve 60 and sucking the slurry S through the fluid ports 36 in the agitator 32 and into the chamber 74. The traveling valve 62, at the proximal end 24 of the mandrel 20, is closed by the differential pressure and traveling valve's biasing spring 94, retaining the slurry S in the chamber 74.

Thereafter, the downstroke of the mandrel 20 and the increase in pressure in the chamber 74, provides sufficient force, aided by the standing valve's biasing spring 94 as necessary, to cause the standing valve 60 to close. As the volume of the chamber 74 decreases, the slurry S therein is displaced through the travelling valve 62. Slurry S is displaced through the ball cage 80 and passageways 96 and uphole into the joints of tubing 18 between the perforated sub 16 and the travelling valve 62. As the joints of tubing 18 fill with slurry S, wellbore fluid F is displaced therefrom through the perforations 76 in the perforated sub 16 to the wellbore.

Periodically the tool 10 is tripped to surface for removal of debris D from the joints of tubing 18. Generally, the operator calculates an amount of accumulated and stored debris D in the joints of tubing 18 for determining when to trip the tool 10. Alternatively, the tool 10 is tripped out the wellbore at regular intervals for removing debris D therefrom.

The embodiments in which an exclusive property or privilege is claimed are defined as follows:

1. A tool for removing debris from a wellbore, the tool adapted to be connected to a downhole distal end of a tubing string, comprising:

a tubular sleeve having a sleeve bore extending axially therethrough and a distal end of the sleeve having an agitator connected thereto for engaging the wellbore obstructions for forming a slurry;

a tubular mandrel adapted for connection to the distal end of the tubing string, the mandrel having an axial bore extending therethrough for fluid connection to an axial bore of the tubing string, the mandrel fit concentrically within the sleeve bore for reciprocation therein between an upstroke and a downstroke, the sleeve bore being fluidly connected to the mandrel bore;

a helical drive arrangement acting between the mandrel and the sleeve for driving the sleeve axially and rotationally along at least a portion of the mandrel during the downstroke and the upstroke of the mandrel;

a one-way standing valve fluidly connected to a distal end of the sleeve bore; and a one way travelling valve fluidly connected to the mandrel's bore;

wherein during the upstroke of the mandrel, a chamber increases in volume in the sleeve bore and slurry is drawn through the standing valve to the chamber; and wherein during the downstroke of the mandrel, the chamber decreases in volume and the slurry is displaced from the chamber through the travelling valve into the tubing string for storage therein.

2. The tool of claim 1 wherein a distal end of the mandrel further comprises a tubular sealing sub for moveably sealing mandrel to the sleeve bore.

3. The tool of claim 2 further comprising:

one or more vanes extending axially from a distal end of the sealing sub for disrupting debris settled adjacent a top of the standing valve.

4. The tool of claim 2 further comprising a velocity tube slideably fit to the bore of the mandrel and extending axially to adjacent a top of the standing valve.

5. The tool of claim 1 wherein the helical drive arrangement comprises:

grooves formed on an outer surface of the mandrel, at least a portion of the grooves being helical; and pins connected to the inner surface of the sleeve for engaging in the grooves.

6. The tool of claim 5 wherein the helical portion extends along an entire length of the mandrel.

7. The tool of claim 5, the grooves further comprising:

the helical portion extending along at least a portion of an entire length of the mandrel; and an axial portion formed along a remainder of a length of the mandrel, the axially portion transitioning to be contiguous with the helical portion.

8. The tool of claim 7, wherein the helical portion is located adjacent a distal end of the mandrel.

9. A workover string for use in clearing debris from a wellbore comprising:

a tubing string;

a tool of claim 1 fluidly connected to a distal end of the tubing string; and a perforated sub located in the tubing string therebetween, forming a storage bore for storing debris therein.

10. A method for clearing and removal of debris from a wellbore comprising:

running a workover string of claim 9 into a wellbore;

lowering the tool thereon to encounter an obstruction in the wellbore; and reciprocating the workover string for agitating the debris for formation of a slurry; and pumping the slurry through the tool for storage in the workover string between the tool and the perforated sub.

11. The method of claim 10 further comprising:

continuing reciprocating the workover string, wellbore fluid from the slurry being delivered to the wellbore through perforations in the perforated sub, the debris remaining in the workover string.

12. The method of claim 10 further comprising:

periodically tripping the workover string out of the wellbore; and removing the debris therefrom.

13. The method of claim 10 wherein the reciprocating further comprises:

rotating the sleeve of the tool for agitating the debris.

* * * * *